US008291725B2

(12) United States Patent
Kundig

(10) Patent No.: US 8,291,725 B2
(45) Date of Patent: Oct. 23, 2012

(54) METHOD FOR COOLING SUPERCONDUCTING MAGNETS

(75) Inventor: Andres Kundig, Uerikon (CH)

(73) Assignee: Linde Aktiengesellschaft, Munich (DE)

( * ) Notice: Subject to any disclaimer, the term of this patent is extended or adjusted under 35 U.S.C. 154(b) by 479 days.

(21) Appl. No.: 12/447,737

(22) PCT Filed: Oct. 31, 2007

(86) PCT No.: PCT/EP2007/009476

§ 371 (c)(1),
(2), (4) Date: Jan. 22, 2010

(87) PCT Pub. No.: WO2008/052777

PCT Pub. Date: May 8, 2008

(65) Prior Publication Data

US 2010/0281888 A1 Nov. 11, 2010

(30) Foreign Application Priority Data

Oct. 31, 2006 (DE) ..... 10 2006 051 880

(51) Int. Cl.
*F25J 1/00* (2006.01)
*F25B 19/00* (2006.01)
*F17C 11/00* (2006.01)

(52) U.S. Cl. ..... 62/608; 62/51.1; 62/46.1

(58) Field of Classification Search ..... 62/46.1, 62/51.1, 608

See application file for complete search history.

(56) References Cited

U.S. PATENT DOCUMENTS 5,889,456 A * 3/1999 Triebe et al. ..... 335/300
7,222,490 B2 * 5/2007 Triebe et al. ..... 62/6
2006/0096301 A1 5/2006 Triebe et al.

FOREIGN PATENT DOCUMENTS

EP 1 655 616 5/2006

OTHER PUBLICATIONS

International Search Report of PCT/EP2007/009476 (Feb. 12, 2008).

* cited by examiner

*Primary Examiner* — Frantz Jules
*Assistant Examiner* — Keith Raymond
(74) *Attorney, Agent, or Firm* — Millen, White, Zelano & Branigan, P.C.

(57) ABSTRACT

The invention describes a method for cooling at least one super-conducting magnet. According to the invention, the cooling of the super-conducting magnet(s) takes place exclusively by means of one or more helium flows which are at at least two temperature levels.

14 Claims, 1 Drawing Sheet

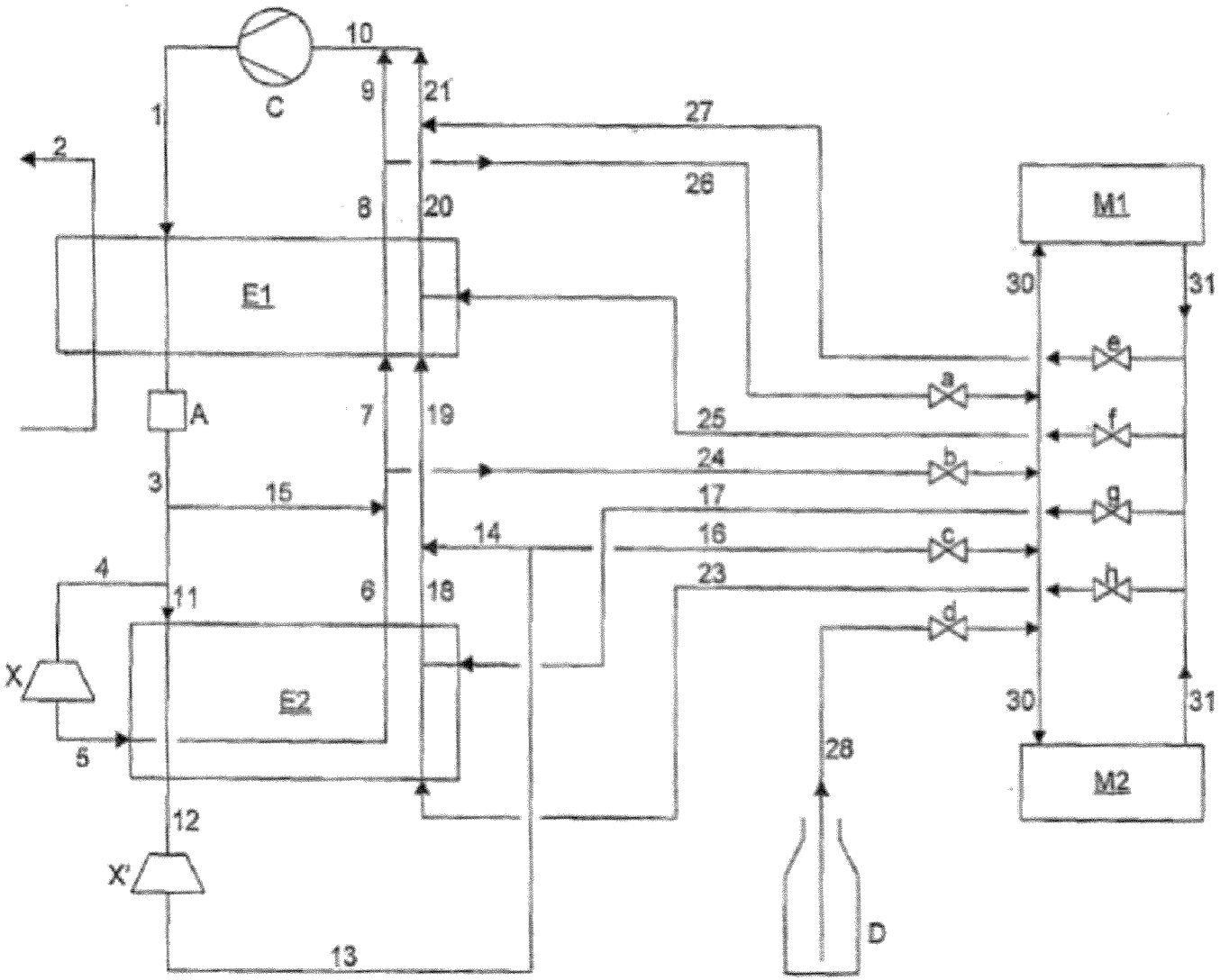
M1
M2
E1
E2
C
A
D
X
X'
a
b
c
d
e
f
g
h
1
2
3
4
5
6
7
8
9
10
11
12
13
14
15
16
17
18
19
20
21
23
24
25
26
27
28
30
31

METHOD FOR COOLING SUPERCONDUCTING MAGNETS

The invention relates to a method for cooling at least one superconducting magnet.

Up to now, superconducting magnets and their cryostats have normally been cooled by the cryostat volume being coated slowly with liquid nitrogen to avoid high material stresses and in this way being cooled to a temperature of about 80 K. Then, the liquid nitrogen that is contained is removed by helium being injected at ambient temperature until both liquid and also gaseous nitrogen are removed—although not completely. In this case, the mean value of the temperature of magnet and cryostats again increases to about 100 to 110 K. Now, the arrangement is cooled by means of liquid helium, which in turn is fed in metered form until it is cooled to a temperature of 4.5 K, before the cryostat volume is then filled with liquid helium.

It is disadvantageous in the described procedure, however, that in particular the consumption of liquid helium is comparatively high because of the large temperature differences that occur because of the process, and in addition, a considerable portion of the helium that is used is lost forever, since it escapes into the environment or atmosphere. Since the worldwide resources of helium are quite limited and correspondingly rising prices are to be noted, there is consequently a need for helium-consuming processes in which as much helium as possible can be recovered.

The "direct use" of liquid nitrogen and the associated contamination results in that the liquid nitrogen cannot be completely removed even by flushing with helium. This fact now has an undesirable influence on the behavior of the superconducting magnets, however, namely their increased tendency to quench, i.e., to suddenly exhibit ohmic resistance again. It is also disadvantageous in the above-described procedure that based on the temperature differences that occur—ambient temperature vs. liquid nitrogen temperature—both when using liquid nitrogen and also in the use of helium, the cooling process is enormously inefficient thermodynamically and thus also economically.

The object of this invention is to indicate a generic method for cooling at least one superconducting magnet, which avoids the above-mentioned drawbacks.

To achieve this object, a method for cooling at least one superconducting magnet is proposed, which is characterized in that the cooling of the superconducting magnet(s) is carried out exclusively by means of one or more helium streams that are at at least two temperature levels.

According to an advantageous embodiment of the method according to the invention for cooling at least one superconducting magnet, the corresponding starting temperatures are produced by mixing helium streams or fractions of varying temperature: In this connection, helium at the temperature level of liquid nitrogen and helium at the ambient temperature level are mixed in a first step, while in a second step, helium at a temperature level of liquid nitrogen and helium at a temperature level of about 10 K are mixed.

According to the invention, however, only helium is now used to cool magnets. Liquid nitrogen optionally is used indirectly as a partial primary cold source—in particular for precooling helium. As a result—assuming that the corresponding pre-cleaning is done—a cryostat volume with negligible residual contaminants is produced. This results in a considerable reduction of the quenching tendency of a correspondingly cooled superconducting magnet. In turn, a considerable reduction of the previously considerable helium losses, which are necessarily connected with the occurrence of the quenching effect, results therefrom.

In addition, in the method for cooling at least one superconducting magnet according to the invention, the temperature difference between the cooling stream or coolant and the magnet to be cooled is comparatively low, which is thermodynamically advantageous. At the same time, the heat transfer coefficient in helium gas can be kept relatively large by a correspondingly larger gas throughput being selected. This gentler cooling of the magnets makes possible an accelerated cooling process, i.e., significantly shorter production process run times.

The process for cooling at least one superconducting magnet according to the invention makes it possible to cool and to fill magnets by means of only one helium cooling device. An undesirable opening of the cryostat of the magnet relative to the atmosphere is thus no longer necessary. Moreover, the filling of the magnets with liquid helium can be carried out comparatively quickly by a liquid helium pump being used. The method according to the invention makes possible, moreover, a considerable saving of liquid helium, which has to be collected, purified, and then liquefied again in the method that is integrated in the prior art. In addition, the helium portion, which is ultimately lost in the atmosphere, is also significantly reduced.

Corresponding to an advantageous embodiment of the method for cooling at least one superconducting magnet according to the invention, the cooling of the superconducting magnet(s) is carried out by a first mixture, consisting of a helium stream at the ambient temperature level and a helium stream at the temperature level of liquid nitrogen, and then a second mixture, consisting of a helium stream at the temperature level of liquid nitrogen and a helium stream at a temperature level of about 10 K, being fed to the magnet that is to be cooled.

The method for cooling at least one superconducting magnet according to the invention as well as other advantageous configurations thereof, which represent subjects of the dependent patent claims, are explained in more detail below based on the embodiment that is depicted in the FIGURE.

For the sake of clarity, a number of the necessary regulating valves are not depicted in the FIGURE. Their representation is not necessary to one skilled in the art, however, because of the following description of the method.

In a diagrammatized form, the FIGURE shows a helium refrigeration circuit that is used in the cooling of two superconducting magnets M1 and M2. By means of a one-stage or multi-stage compressor unit C—in this connection, preferably a screw compressor system is used—helium is sucked in at approximately ambient pressure and compressed at a pressure of between about 13 and 20 bar (high pressure). A (water) cooler and oil separator optionally downstream from the compressor unit C are not shown in the FIGURE.

The high-pressure helium stream is fed via line 1 to a first heat exchanger E1 and is cooled to about 80 K in the latter against medium-pressure and low-pressure helium streams—which will be further discussed below—as well as against liquid nitrogen, which is fed via line 2 through the heat exchanger E1.

Then, a preferably adsorptively designed purification A of the cooled high-pressure helium stream is carried out. In this purification stage A, a separation of the optionally present, undesirable residual contaminants, such as, for example, air, is carried out. The adsorption unit A is preferably designed to have redundancy and has, moreover, agents for regeneration of the charged adsorption agent.

The helium stream that is drawn off via line 3 from the first heat exchanger E1 can now be divided into three partial streams 4, 11 and 15. The first-mentioned partial stream is fed via line 4 to an expansion turbine X and is depressurized in the latter to a medium pressure of between 2 and 3 bar. Then, this medium-pressure helium stream is guided via the line sections 5 to 10 through the two heat exchangers E2 and E1 and heated in the latter up to ambient temperature before it is fed to the compressor unit C.

The above-mentioned second helium stream is fed via line 11 to the second heat exchanger E2 and is further cooled in the latter against process streams that are to be heated. Via line 12, this partial helium stream is fed to a second expansion turbine X' after passage through the heat exchanger E2 of a second expansion turbine X' and is depressurized in the latter also while generating cold at a temperature of about 10 K at a medium pressure of between 2 and 3 bar. Also, this medium-pressure helium stream is fed to the compressor unit C via the line sections 13, 14, 19 to 21 and 10 after being heated to ambient temperature in the heat exchanger E1.

The above-mentioned third partial helium stream can also be fed via the line sections 15 and 7 to 10 to that of the compressor unit C.

Three medium-pressure helium streams thus are present at varying temperature levels. These are the helium stream that has a temperature of about 10 K and that is depressurized in the second expansion turbine X', the helium stream that has a temperature of about 80 K and that is present at the outlet of the heat exchanger E1, and the helium stream in line 8 that is heated in the heat exchangers E2 and E1 to ambient temperature.

As already mentioned, the FIGURE shows a helium cooling unit that is used to cool only two superconducting magnets M1 and M2. The cryostat volumes of magnets M1 and M2 are evacuated from the actual cooling process if necessary (several times), flushed, and undesirable residues or contaminants, such as air and moisture, are to a great extent removed therefrom by circulation of dry helium gas. For the sake of clarity, the devices that are necessary for this purpose are not shown in the FIGURE.

At the beginning of the actual cooling process, when valve a is open, the medium-pressure helium gas that is at ambient temperature is fed via the line sections 26 and 30 to the magnet(s) M1/M2 that are to be cooled. At the same time, when valve b is open, medium-pressure helium gas, which has a temperature of about 80 K, is fed via the line sections 24 and 30 to the magnets M1/M2 that are to be cooled. By mixing the two above-mentioned medium-pressure helium streams, any desired starting temperature can be set between ambient temperature and a temperature of about 80 K. Thus, a continuous cooling of the magnets M1/M2 from ambient temperature up to a temperature level of about 80 K is achieved.

Via the line sections 31 and 25, when valve f is open, the heated waste gas that is drawn off from the magnets M1/M2 is fed again to the heat exchanger E1, heated in the latter, and then fed via the line sections 20, 21 and 10 to the compressor unit C.

As soon as the magnets M1/M2 have reached a temperature of somewhat above 80 K—the helium supply via line 26 is already closed again at this point in time and helium is fed only via line 24—valve c is opened so that medium-pressure helium gas, which has a temperature of about 10 K, can be added via the line sections 16 and 30 or fed to the magnets M1/M2. The starting temperature is reduced again by means of this method step.

In addition, when valve f is open, the heated waste gas that leaves the magnets M1/M2 is fed via the line sections 31 and 25 to the first heat exchanger E1. This recycling is carried out, however, only until the temperature—this is between 50 and 60 K—drops below a certain value. Then, valve f is closed, and valve g is opened. Now, the heated waste gas can be fed via the line sections 31 and 17 to the second heat exchanger E2. From the latter, it is fed via the line sections 18 to 21 and 10 of the compressor unit C.

If the temperature of the waste gas that is drawn off from the magnets M1/M2 reaches the outlet temperature of the second expansion turbine X', valve g is closed and valve h is opened. Now, the heated waste gas is fed via the line sections 31 and 23 to the cold end of the heat exchanger E2 and heated in the latter. This waste gas is also fed by the heat exchanger E1 and the compressor unit C via the line sections 18 to 21 and 10.

When falling below a certain temperature difference—this is preferably 0.5 to 1 K—between the temperature of the waste gas that is drawn off from the magnets M1/M2 and the outlet temperature of the expansion turbine X', valve c is closed, and valve d is opened. Via the line sections 28 and 30, the magnets M1/M2 are now coated with liquid helium from the Dewar D, in this case brought completely to saturated vapor temperature and filled with liquid helium. The cold helium gas that was displaced in this case can be fed to the compressor unit C via valve e and lines 27, 21, and 10 and/or can be used to cool additional magnets whose cooling processes take place at different times. Alternatively to this, this helium gas can also be recycled or forced through a line, not shown in the FIGURE, in the Dewar D; to this end, however, the use of a liquid helium pump is required.

The sequence of the previously described procedure can be carried out fully automatically—beginning with the purification of the cryostats and ending with the filling of the cryostats with liquid helium. This has the advantage that human error can be ruled out.

The method for cooling at least one superconducting magnet according to the invention is suitable in particular for implementation in a helium cooling unit, which is used in the parallel cooling of superconducting MRI magnets and in the filling of cryostats with liquid. In addition, however, the method according to the invention can also be used for cooling at least one superconducting magnet whenever comparatively gentle cooling is necessary, only comparatively small temperature differences are allowed to occur or should occur, the cooling speed has to be monitored, a relatively high helium throughput is advantageous or desired, and contaminants are not desired.

The method for cooling at least one superconducting magnet according to the invention makes possible the parallel cooling and filling of one or more magnets at different times, whereby the number of magnets that are to be cooled in principle can be of any size.

The invention claimed is:

1. A method for cooling down at least one superconducting magnet, comprising:

cooling down said at least one superconducting magnet by cooling said at least one superconducting magnet with a mixture of at least two helium streams that are at at least two different temperature levels;

wherein the cooling down of said at least one superconducting magnet is carried out by cooling said at least one superconducting magnet with a first mixture, consisting essentially of a first helium stream at ambient temperature level and a second helium stream at a first lower temperature level, and then cooling said at least one superconducting magnet with a second mixture, consisting essentially of said second helium stream at said first lower temperature level and a third helium stream at a second lower temperature level, wherein said second lower temperature is a lower temperature than said first lower temperature level, said method further comprising compressing a helium stream in a compressor to provide a high pressure helium stream, subjecting said high pressure helium stream to a first indirect heat exchange wherein said high pressure helium stream undergoes heat exchange with liquid nitrogen, and dividing the resultant cooled high pressure helium stream into at least three portions, expanding a first portion of the resultant cooled high pressure helium stream to provide a first medium pressure helium stream, combining a second portion of the resultant cooled high pressure helium with said first medium pressure helium stream wherein at least portion of the resultant mixture of said second portion of the cooled high pressure helium stream and said first medium pressure helium stream is used as said second helium stream, and cooling a third portion of the resultant cooled high pressure helium in a second heat indirect exchange wherein said third portion of the cooled high pressure helium is cooled by heat exchange with said first medium pressure helium stream, and then expanding said third portion of the cooled high pressure helium to provide a second medium pressure helium stream, wherein at least a portion of said second medium pressure helium stream is used as said third helium stream.

2. The method according to claim 1, wherein the cooling down said at least one superconducting magnet is carried out by cooling said at least one superconducting magnet with said first mixture of said first helium stream and said second helium stream wherein the amounts of said first helium stream and said second helium stream used for forming said first mixture are varied so as to decrease the temperature of said first mixture, then cooling said at least one superconducting magnet with solely said second helium stream, and then cooling said at least one superconducting magnet with said second mixture of said second helium stream and said third helium stream wherein the amounts of said second helium stream and said third helium stream used for forming said second mixture are varied so as to decrease the temperature of said second mixture.

3. The method according to claim 2, wherein, prior to forming said first mixture and said second mixture and prior to cooling said at least one superconducting magnet, said second stream is cooled to said first lower temperature level by heat exchange with liquid nitrogen.

4. The method according to claim 1, wherein in said first indirect heat exchange said high pressure helium stream is also cooled by indirect heat exchange with at least a portion of said first medium pressure helium stream.

5. The method according to claim 4, wherein, after said first indirect heat exchange with said high pressure helium stream, at least a portion of said first medium pressure helium stream is used as said first helium stream.

6. The method according to claim 1, wherein gas displaced by said first mixture during the cooling of said at least one superconducting magnet by said first mixture is sent to said first indirect heat exchange, wherein the gas displaced by said first mixture undergoes heat exchange with said high pressure helium stream, and the gas displaced by said first mixture is sent to said compressor.

7. The method according to claim 1, wherein gas displaced by said second mixture during the cooling of said at least one superconducting magnet by said second mixture is sent to said first indirect heat exchange, wherein the gas displaced by said second mixture undergoes heat exchange with said high pressure helium stream, and gas displaced by said first mixture is sent to said compressor.

8. The method according to claim 1, wherein gas displaced by said second mixture during the cooling of said at least one superconducting magnet by said second mixture is sent to said second indirect heat exchange, wherein the gas displaced by said second mixture undergoes heat exchange with said second medium pressure helium stream, then the gas displaced by said second mixture is sent to said first indirect heat exchange, wherein the gas displaced by said second mixture undergoes heat exchange with said high pressure helium stream, and then the gas displaced by said second mixture is sent to said compressor.

9. The method according to claim 6, wherein gas displaced by said second mixture during the cooling of said at least one superconducting magnet by said second mixture is sent to said first indirect heat exchange, wherein the gas displaced by said second mixture undergoes heat exchange with said high pressure helium stream, and the gas displaced by said first mixture is sent to said compressor.

10. The method according to claim 6, wherein gas displaced by said second mixture during the cooling of said at least one superconducting magnet by said second mixture is sent to said second indirect heat exchange, wherein the gas displaced by said second mixture undergoes heat exchange with said second medium pressure helium stream, then the gas displaced by said second mixture is sent to said first indirect heat exchange, wherein the gas displaced by said second mixture undergoes heat exchange with said high pressure helium stream, and then the gas displaced by said second mixture is sent to said compressor.

11. The method according to claim 1, wherein (a) initially gas displaced by said second mixture during the cooling of said at least one superconducting magnet by said second mixture is sent to said first indirect heat exchange, wherein the gas displaced by said second mixture undergoes heat exchange with said high pressure helium stream, and the gas displaced by said second mixture is sent to said compressor; and (b) subsequently gas displaced by said second mixture during the cooling of said at least one superconducting magnet by said second mixture is sent to said second indirect heat exchange, wherein the gas displaced by said second mixture undergoes heat exchange with said second medium pressure helium stream, then the gas displaced by said second mixture is sent to said first indirect heat exchange, wherein the gas displaced by said second mixture undergoes heat exchange with said high pressure helium stream, and then the gas displaced by said second mixture is sent to said compressor.

12. The method according to claim 6, wherein (a) initially gas displaced by said second mixture during the cooling of said at least one superconducting magnet by said second mixture is sent to said first indirect heat exchange, wherein the gas displaced by said second mixture undergoes heat exchange with said high pressure helium stream, and the gas displaced by said second mixture is sent to said compressor; and (b) subsequently gas displaced by said second mixture during the cooling of said at least one superconducting magnet by said second mixture is sent to said second indirect heat exchange, wherein the gas displaced by said second mixture undergoes heat exchange with said second medium pressure helium stream, then the gas displaced by said second mixture is sent to said first indirect heat exchange, wherein the gas displaced by said second mixture undergoes heat exchange with said high pressure helium stream, and then the gas displaced by said second mixture is sent to said compressor.

13. The method according to claim 2, wherein, after cooling said at least one superconducting magnet with said second mixture, said at least one superconducting magnet is cooled by liquid helium.

14. The method according to claim 1 wherein, said at least one superconducting magnet is cooled down from ambient temperature to a temperature below 80K.

* * * * *